US011596827B2

(12) United States Patent
Anderson et al.

(10) Patent No.: US 11,596,827 B2
(45) Date of Patent: Mar. 7, 2023

(54) BI-DIRECTIONAL EXERCISE MACHINES

(71) Applicant: Life Fitness, LLC, Rosemont, IL (US)

(72) Inventors: Christian Shea Anderson, Lakeville, MN (US); John R. Lindemeier, Oak Grove, MN (US)

(73) Assignee: Life Fitness, LLC, Franklin Park, IL (US)

( * ) Notice: Subject to any disclaimer, the term of this patent is extended or adjusted under 35 U.S.C. 154(b) by 138 days.

(21) Appl. No.: 17/148,282

(22) Filed: Jan. 13, 2021

(65) Prior Publication Data

US 2022/0219036 A1 Jul. 14, 2022

(51) Int. Cl.
*A63B 21/00* (2006.01)
*A63B 21/062* (2006.01)
(Continued)

(52) U.S. Cl.
CPC ..... *A63B 21/155* (2013.01); *A63B 21/063* (2015.10); *A63B 21/15* (2013.01); *A63B 21/151* (2013.01); *A63B 21/154* (2013.01); *A63B 21/4035* (2015.10); *A63B 21/4047* (2015.10); *A63B 23/035* (2013.01); *A63B 23/12* (2013.01); *A63B 23/1281* (2013.01); *A63B 21/06* (2013.01);
(Continued)

(58) Field of Classification Search
CPC . A63B 21/155; A63B 21/063; A63B 21/4047; A63B 21/154; A63B 21/151; A63B 21/15; A63B 21/0628; A63B 21/0626; A63B 21/062; A63B 21/06; A63B 21/4035; A63B 22/18; A63B 22/0005; A63B 23/1281; A63B 23/12; A63B 21/0624; A63B 23/1209; A63B 23/035
See application file for complete search history.

(56) References Cited

U.S. PATENT DOCUMENTS 4,239,210 A * 12/1980 Lambert, Jr. ..... A63B 21/155 482/137
4,456,245 A * 6/1984 Baldwin ..... A63B 21/155 482/136
(Continued)

OTHER PUBLICATIONS

Sports Art Industrial Co. Ltd., Bicep/Tricep DF-105 Owner's Manual Assembly Instructions. 2009.
(Continued)

*Primary Examiner* — Gary D Urbiel Goldner
(74) *Attorney, Agent, or Firm* — Andrus Intellectual Property Law, LLP

(57) ABSTRACT

A bi-directional exercise machine has a work arm, first and second cams coupled to the work arm, a resistance mechanism, and a pulley assembly that couples the resistance mechanism to the work arm via the first and second cams so that movement of the work arm is resisted by the resistance mechanism according to first and second resistance profiles provided by the first and second cams, respectfully. A primary pulley cable has a first end coupled to the first cam and a second end coupled to the second cam. When the work arm is in a rest position, the ends of the primary pulley cable extend from cable tracks of the cams, respectively, at a tangent so that the resistance mechanism applies a resistance force on the work arm via the pulley assembly immediately upon movement of the work arm out of the rest position.

20 Claims, 10 Drawing Sheets

(51) Int. Cl.
*A63B 23/12* (2006.01)
*A63B 23/035* (2006.01)
*A63B 21/06* (2006.01)

(52) U.S. Cl.
CPC ..... *A63B 21/062* (2013.01); *A63B 21/0626* (2015.10); *A63B 21/0628* (2015.10); *A63B 21/4033* (2015.10)

(56) References Cited

U.S. PATENT DOCUMENTS 5,102,121 A * 4/1992 Solow ..... A63B 21/0628 482/137
5,667,465 A * 9/1997 McCollum ..... A63B 21/0628 482/137
5,885,193 A 3/1999 Habing et al.
6,361,482 B1 * 3/2002 Batea ..... A63B 23/0355 482/142
7,537,551 B2 * 5/2009 Steffee ..... A63B 21/0628 482/137
7,981,010 B1 * 7/2011 Webber ..... A63B 21/159 482/137
9,480,869 B1 11/2016 Meyer et al.
10,478,659 B2 * 11/2019 O'Connor ..... A63B 21/159
10,786,705 B2 * 9/2020 Davis ..... A63B 21/0622
2011/0034304 A1 2/2011 Kuo

OTHER PUBLICATIONS

Sports Art, DF205 BICEP/TRICEP, accessed on Jan. 11, 2021 via https://www gosportsart.com/product/df205-bicep-tricep/.
Sports Art, DF200 LEG Extension/LEG Curl, accessed on Jan. 11, 2021 via https://www.gosportsart.com/product/df200-leg-extension-leg-curl/.
FFITTECH, (Dual) Biceps and Triceps, accessed on Jan. 11, 2021 via https://www.ffittech.com/products/dual-biceps-triceps.
True Fitness, SD-1001 BICEPS/TRICEPS, accessed on Jan. 11, 2021 via https://truefitness.com/commercial-fitness/force-biceps-triceps/.
Body Solid, GGCBT-STK Pro-Select BICEPS & TRICEPS Machine, accessed on Jan. 11, 2021 via https://www.bodysolid.com/home/gcbt-stk/pro-select_biceps_triceps_machine.

* cited by examiner

BI-DIRECTIONAL EXERCISE MACHINES

FIELD

The present disclosure relates to exercise machines and more particularly to bi-directional exercise machines, for example but not limited to for performing both biceps curl and triceps extension exercise motions.

BACKGROUND

The following U.S. patents and application are hereby incorporated herein by reference.

U.S. Pat. No. 5,885,193 discloses a mechanism which applies exercise resistance to a rotating member in both directions of rotation without a significant "dead zone" surrounding the neutral position. A cam is rotatably mounted to the frame of an exercise machine. A flexible member, which may be a belt, cable, chain or the like, is attached to a peripheral surface of the cam and is loaded by the exercise weights or other source of exercise resistance. The flexible member is guided around a pulley mounted on an arm that is pivotally attached to the cam to maintain the flexible member close to the peripheral surface of the cam. A pair of stops act on the arm to engage the arm for rotation with the cam in one direction and to prevent rotation of the arm with the cam in the opposite direction.

U.S. Patent Application Publication No. 2011/0034304 discloses a weight lifting exercising device having a number of weight plates slidably attached to a frame with a weight guide rod, two cam members pivotally attached to the frame, two cables coupled between the cam members and the weight plates for moving the selected number of the weight plates up and down along the weight guide rod, and an operating device engaged with the cam members for rotating either of the cam members to actuate either of the cables to move the weight plates up and down along the weight guide rod and for allowing the user to lift and to exercise the weight members either by pulling or pushing a force transfer member and for training or exercising the lower or the upper muscle groups of the users.

U.S. Pat. No. 9,480,869 discloses exercise equipment having a weight stack configured to oppose a given exercise motion through a cable and pulley system and an elongated connector connecting the cable to a weight stack. The elongated connector comprises a first threaded portion located proximate to the weight stack and a second portion located distal from the weight stack. The first threaded portion is engaged with the weight stack and has a diameter that is greater than a diameter of the second portion such that an operator can visually determine whether the connector is fully engaged with a threaded receptacle in the weight stack.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

A bi-directional exercise machine has a work arm, first and second cams coupled to the work arm, a resistance mechanism, and a pulley assembly that couples the resistance mechanism to the work arm via the first and second cams, in particular so that movement of the work arm is resisted by the resistance mechanism according to first and second resistance profiles provided by the first and second cams, respectfully. The pulley assembly has a primary pulley cable having a first end coupled to the first cam and a second end coupled to the second cam. When the work arm is in a rest position, the first and second ends of the primary pulley cable both extend at a tangent from cable tracks of the first and second cams, respectively, in particular so that the resistance mechanism applies a resistance force on the work arm via the pulley assembly immediately upon movement of the work arm out of the rest position.

Various other features, objects, and advantages of the invention will be made apparent from the following description taken together with the drawings.

BRIEF DESCRIPTION OF THE DRAWINGS

The present disclosure includes the following Figures.

DETAILED DESCRIPTION

The present disclosure is a result of the present inventors' research and development regarding bi-directional exercise machines that facilitate for example but not limited to biceps curl and triceps extension exercises. Conventional exercise machines for facilitating bi-directional motion often utilize the cam mechanism disclosed in the above-incorporated U.S. Pat. No. 5,885,193. This mechanism, while effective at mitigating "dead zones" surrounding the neutral position of the device, does not permit the resistance profile of one side of the cam to be defined completely independent of the resistance profile of the other side of the cam. The term "dead zones" is defined in the above-incorporated patent as a substantial range of motion of the cam about the neutral position in which the pulley cable is not in contact with the cam surface and thus the profile of the cam surface has no effect on the amount of the exercise resistance within this range of motion. This "dead zone" thus detracts from the effectiveness of the exercise. The present inventors identified this drawback in the prior art and presently endeavored to provide an improved exercise machine that mitigates the "dead zones" surrounding the neutral position of the device, while also facilitating bi-directional resistance with the freedom to shape both resistance profiles to any desired target, independent of one another. The embodiments shown and described herein below are novel and non-obvious improvements that overcome these deficiencies in the prior art.

Figure 1:
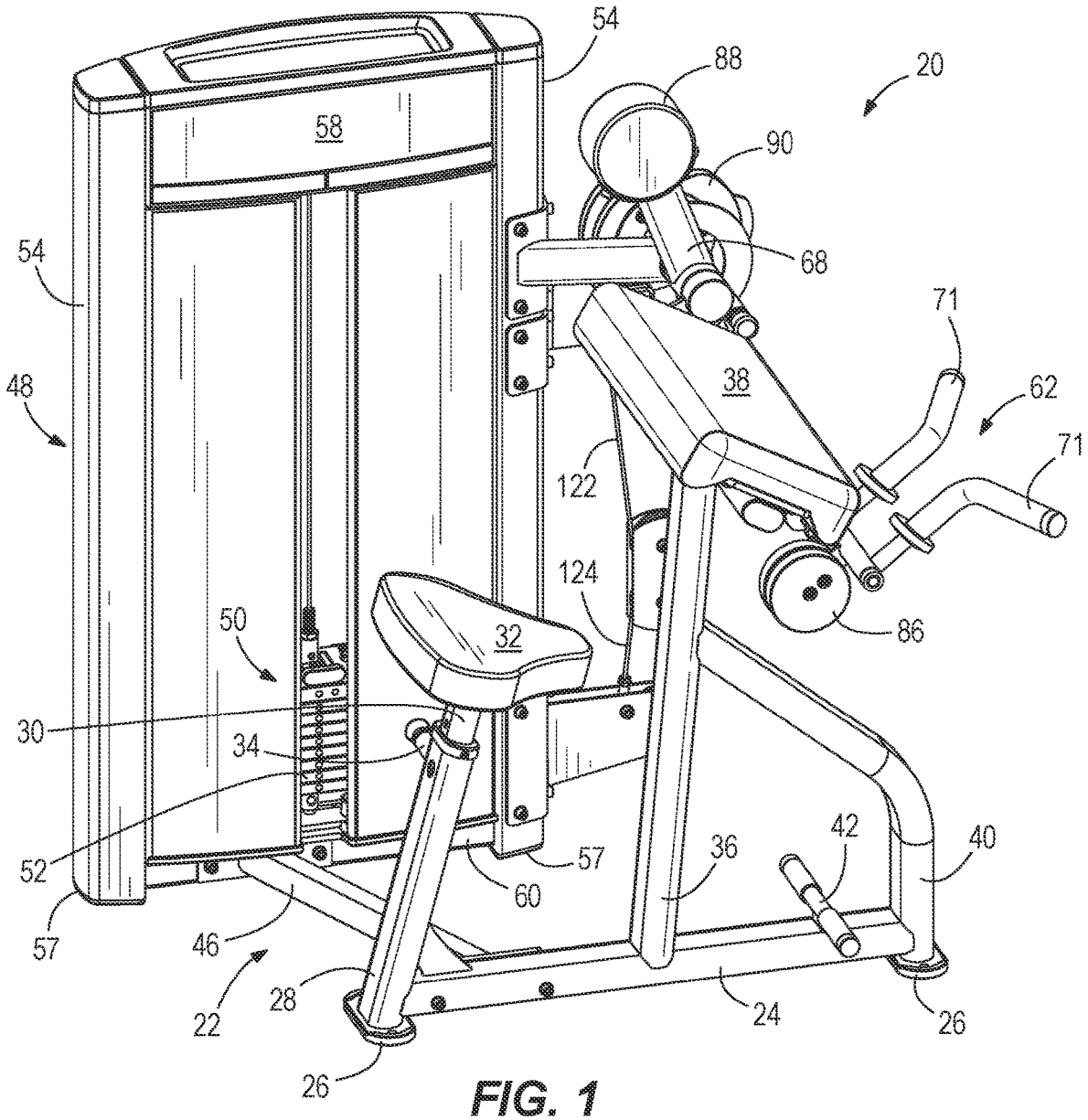
FIG. 1 is a side perspective view of an exercise machine having a stationary frame, a weight stack, a work arm, and a pulley system that couples the work arm to the weight stack.
Figure 2:
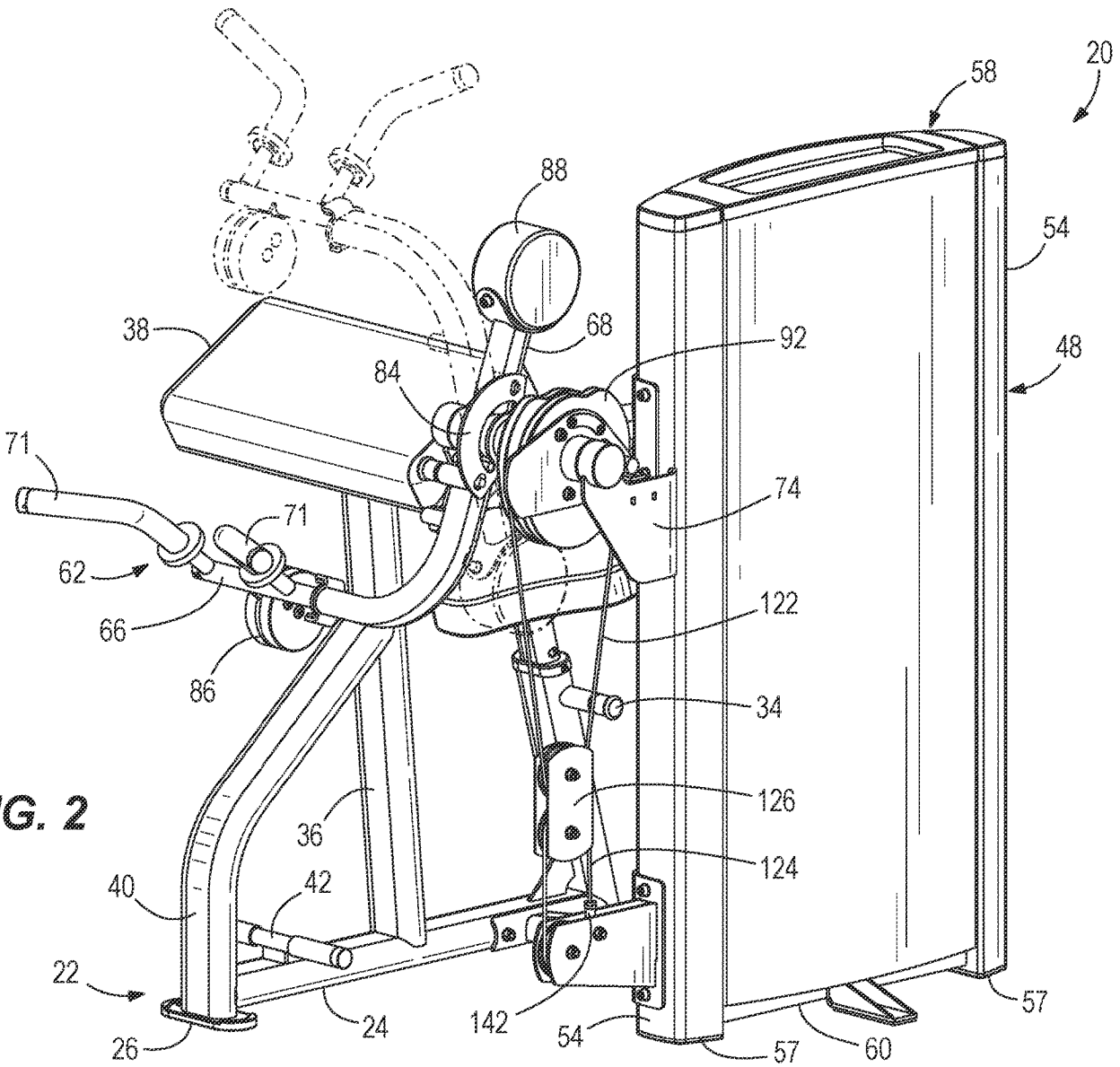
FIG. 2 is an opposite side perspective view of the exercise machine, showing the work arm in a first rest position in solid line and in a second rest position in dash-and-dot line.

FIGS. 1 and 2 depict an exemplary bi-directional exercise machine 20 for performing a biceps curl exercise motion and alternately for performing a triceps extension exercise motion. The exercise machine 20 has a stationary frame 22 comprising various rigidly connected frame arms. More specifically, a first frame arm 24 is supported by ground-engaging feet 26. A second frame arm 28 extends upwardly from the rear end of the first frame arm 24 and supports a telescopically-adjustable seat post 30 for a seat pad 32. A spring-loaded pin 34 is configured to retain the seat post 30 at various heights relative to the second frame arm 28 to accommodate users of different heights. A third frame arm 36 extends upwardly from a medial portion of the first frame arm 24 and supports an arm pad 38 for supporting the user's upper arms, between the user's elbows and shoulders. A fourth frame arm 40 extends upwardly from a forward end of the first frame arm 24 and is angularly connected to a medial portion of the third frame arm 36, for providing structural support for the third frame arm 36 and arm pad 38. A foot bar 42 laterally extends from the sides of a forward medial portion of the first frame arm 24 and provides opposing foot pegs for supporting the user's feet. A fifth frame arm 46 laterally extends from a rearward medial portion of the first frame arm 24, between the second and third frame arms 28, 36. The fifth frame arm 46 is connected to a supporting frame 48 for a resistance mechanism of the exercise machine 20, which in the illustrated example is a conventional weight stack 50.

Figure 3:
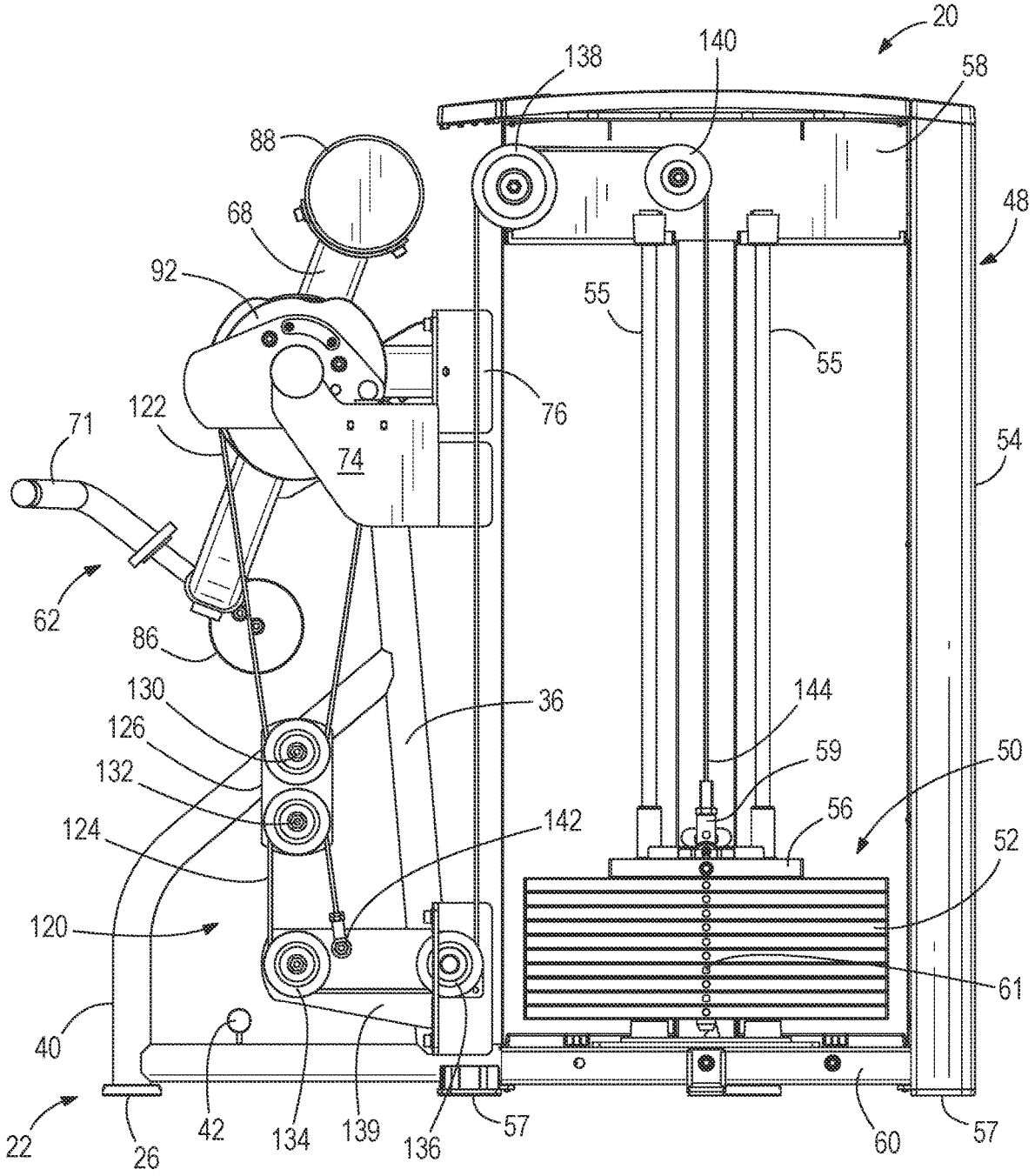
FIG. 3 is a side view of the exercise machine having cover portions removed from the supporting frame for the weight stack to better illustrate the pulley system.

Referring to FIG. 3, the supporting frame 48 for the weight stack 50 has opposing support columns 54 with ground-engaging feet 57. Header 58 and footer 60 connect the top and bottom of the support columns 54, respectively. A stack of weight plates 52 are slidable up and down along weight bars 55, which are mounted to a cross-bar located in the header 58 and a corresponding cross-bar located in the footer 60 of the supporting frame 48. A head plate 56 is disposed on top of the weight stack 50 and carries a bayonet 59 that extends down through center holes in the weight plates 52. Each weight plate 52 has a laterally-extending engagement hole 61 through which a selector pin can be manually inserted into engagement with a corresponding engagement hole in the bayonet 59, to thereby select an amount of resistance provided by the weight stack 50 during an exercise motion on the exercise machine 20. This type of weight stack 50 is a conventional mechanism and an example is further described in the above-incorporated U.S. Pat. No. 9,480,869.

Figure 4:
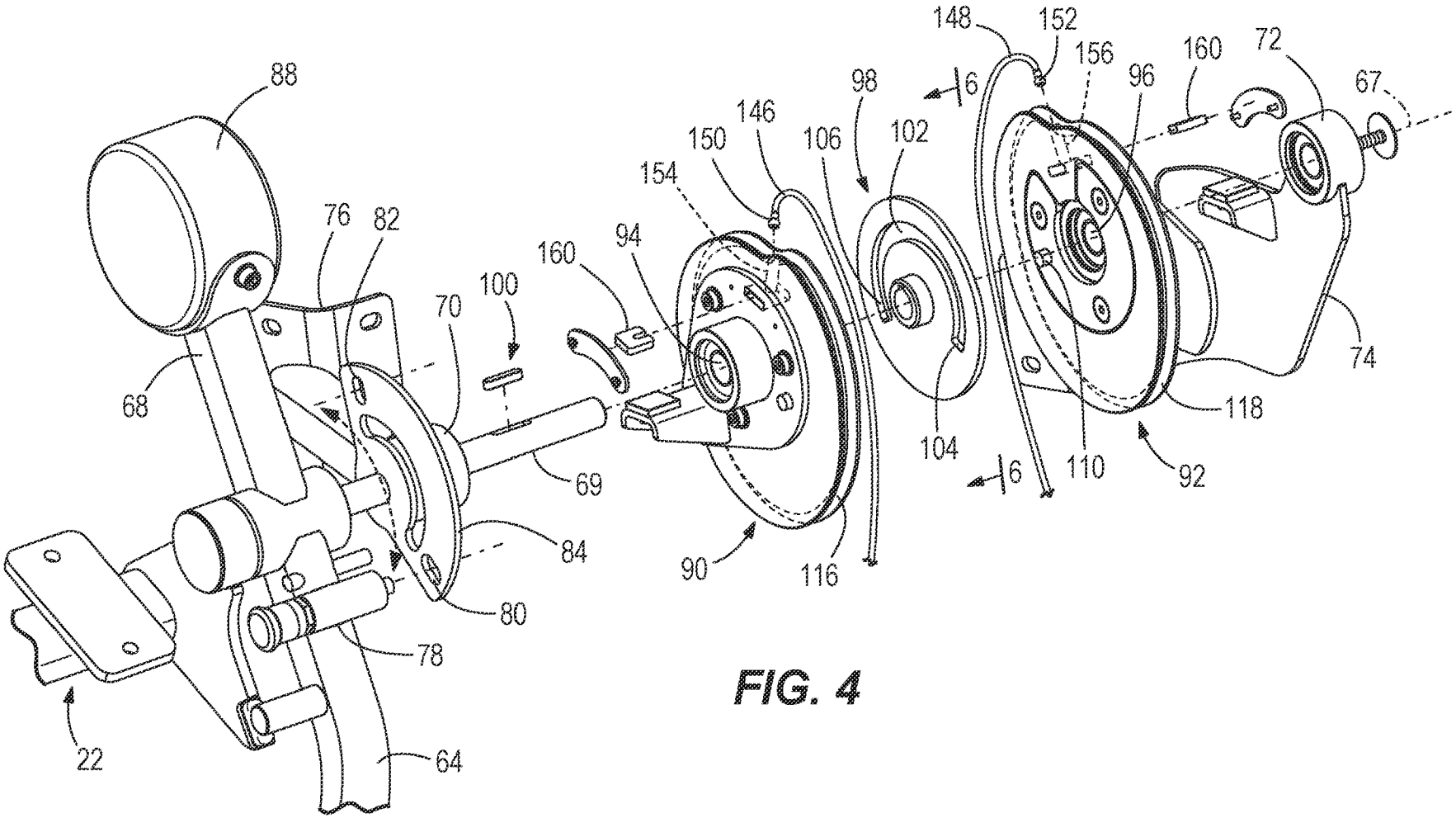
FIGS. 4 and 5 are opposing exploded views of the machine's work arm and first and second cams that can be configured to provide the same or different resistance profiles for biceps curl and triceps extensions, respectively.
Figure 5:
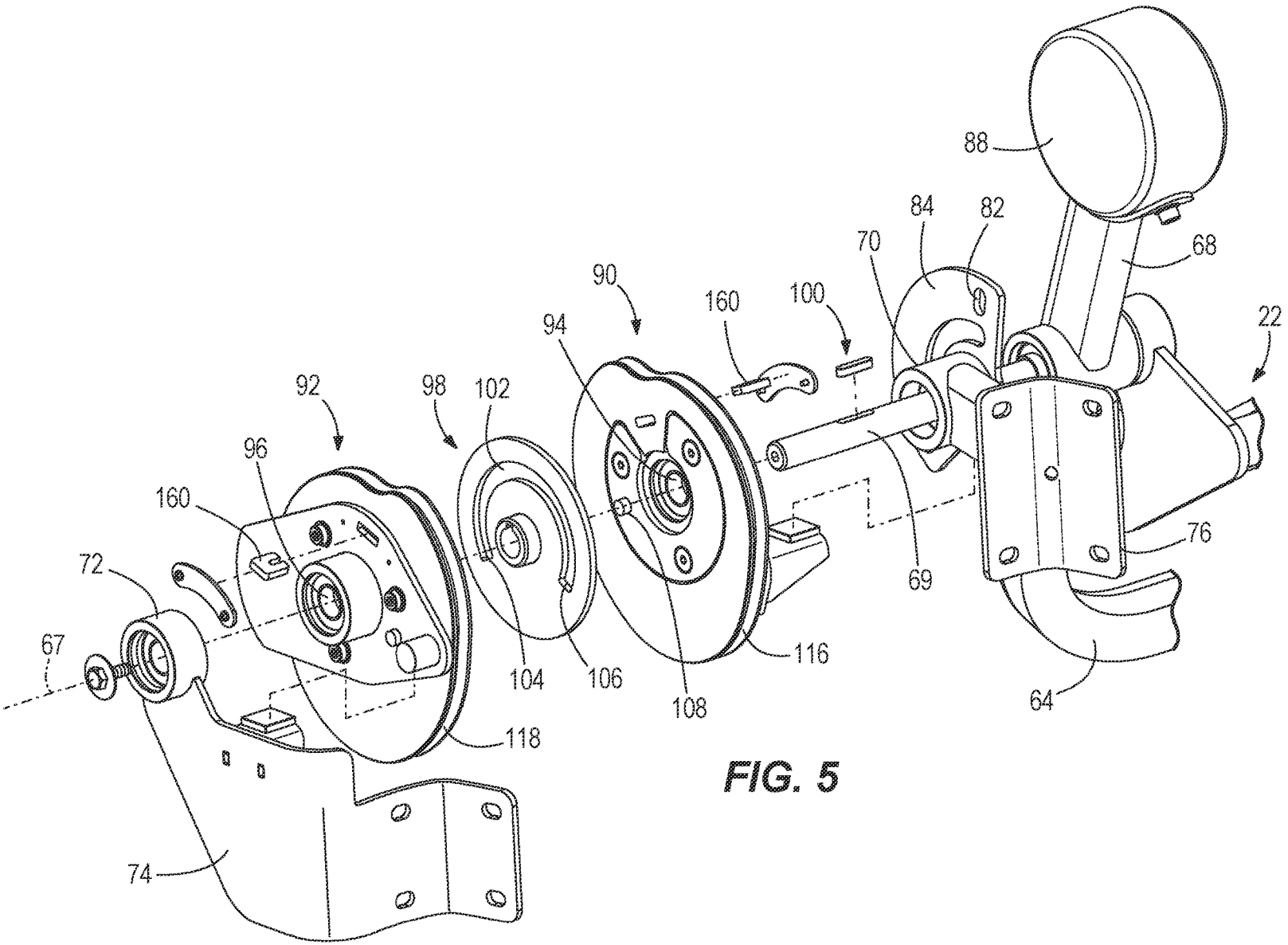

Referring to FIGS. 1-3, the exercise machine 20 has a work arm 62 that is movable/pivotable into various positions for performance of the biceps curl exercise motion and alternately the triceps extension exercise motion, as will be further described herein below with reference to FIGS. 6-9. Referring now to FIG. 2, the work arm 62 has an L-shaped handlebar 64 with transversely oriented first and second portions 66, 68. Handles 71 extend from the first portion 66 and are for manually grasping by the user sitting on the seat pad 32, while having upper arms resting on the arm pad 38. The handlebar 64 is pivotable with respect to the stationary frame 22 about a pivot axis 67, which is shown in FIGS. 4 and 5. A driven shaft 69 extends from the second portion 68 of the handlebar 64 along the pivot axis 67 and is supported for rotation about the pivot axis 67 via bearings 70, 72. The bearings 70, 72 are disposed on brackets 74, 76 that are rigidly connected to a medial portion of the support column 54.

Referring to FIGS. 4 and 5, a spring-loaded selector pin 78 on the second portion 68 of the handlebar 64 is engageable with selector holes 80, 82 on a selector plate 84 mounted to the stationary frame 22 via, among other things, the bracket 76. Engagement of the spring-loaded selector pin 78 in selector hole 80 locates the work arm 62 in the rest position shown in solid lines in FIG. 2, which is for performance of a biceps curl exercise motion. Alternately, engagement of the spring-loaded selector pin 78 in selector hole 82 locates the work arm 62 in the rest position shown in dash-and-dot lines in FIG. 2, which is for performance of a triceps extension exercise motion. Thus the spring-loaded selector pin 78 and selector plate 84 conveniently allow the user to manually reposition the handlebar 64 into the positions shown in solid and in dash-and-dot lines in FIG. 2, depending on whether the user desires to perform the biceps curl exercise motion or the triceps extension exercise motion. Counterweights 86, 88 are located on the first and second portions 66, 68 of the handlebar 64, respectively, to balance the weight of the handlebar 64 relative to the pivot axis 67 and in particular to facilitate safe manual positioning of the handlebar 64 into the respective positions shown in solid and dash-and-dot lines in FIG. 2, for example discouraging over-rotation of the handles 71 and maintaining a balanced position of the handles 71 when transitioning between the biceps curl rest position and triceps extension rest position.

First and second cams 90, 92 are disposed on the driven shaft 69. The first and second cams 90, 92 have center holes 94, 96, respectively, through which the driven shaft 69 extends, in particular such that the driven shaft 69 is rotatable relative to the first and second cams 90, 92 and thus relative to the pivot axis 67. An actuator plate 98 is keyed to the driven shaft 69 by a key 100 such that rotation of the driven shaft 69 about the pivot axis 67 causes rotation of the actuator plate 98 about the pivot axis 67. The actuator plate 98 is located axially between the first and second cams 90, 92. As further described herein below, the actuator plate 98 is engaged with the first and second cams 90, 92 and configured to cause rotation of the first and second cams 90, 92 about the pivot axis 67 depending upon whether the user is performing the biceps curl exercise motion or the triceps extension exercise motion. The actuator plate 98 has an arcuate slot 102 with a first slot end 104 and an opposite second slot end 106. The first and second cams 90, 92 have engagement fingers 108, 110 which axially extend into opposite ends of the arcuate slot 102.

Figure 6:
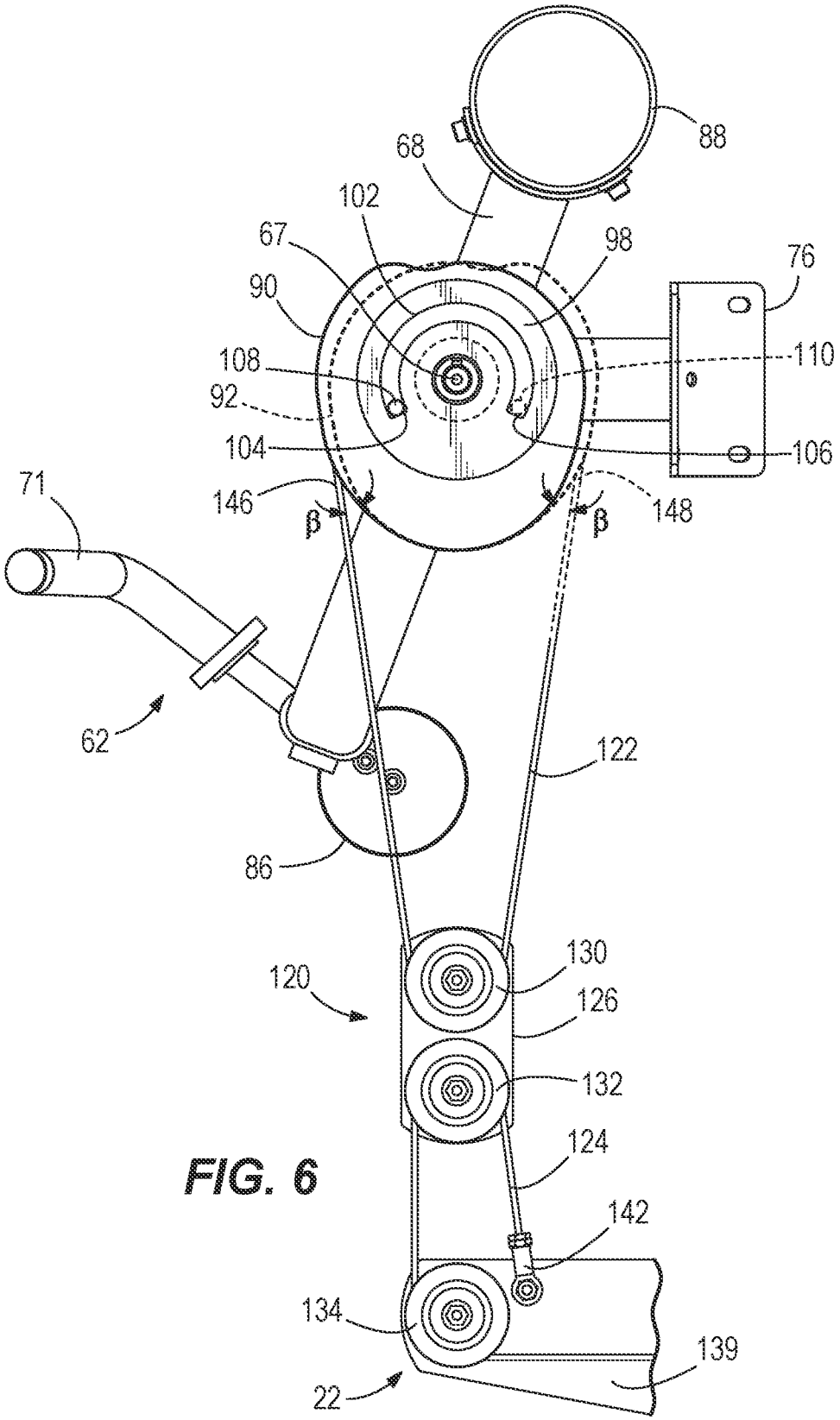
FIG. 6 is a view of section 6-6, taken in FIG. 4, showing the work arm in a rest position for performance of a biceps curl exercise motion.
Figure 7:
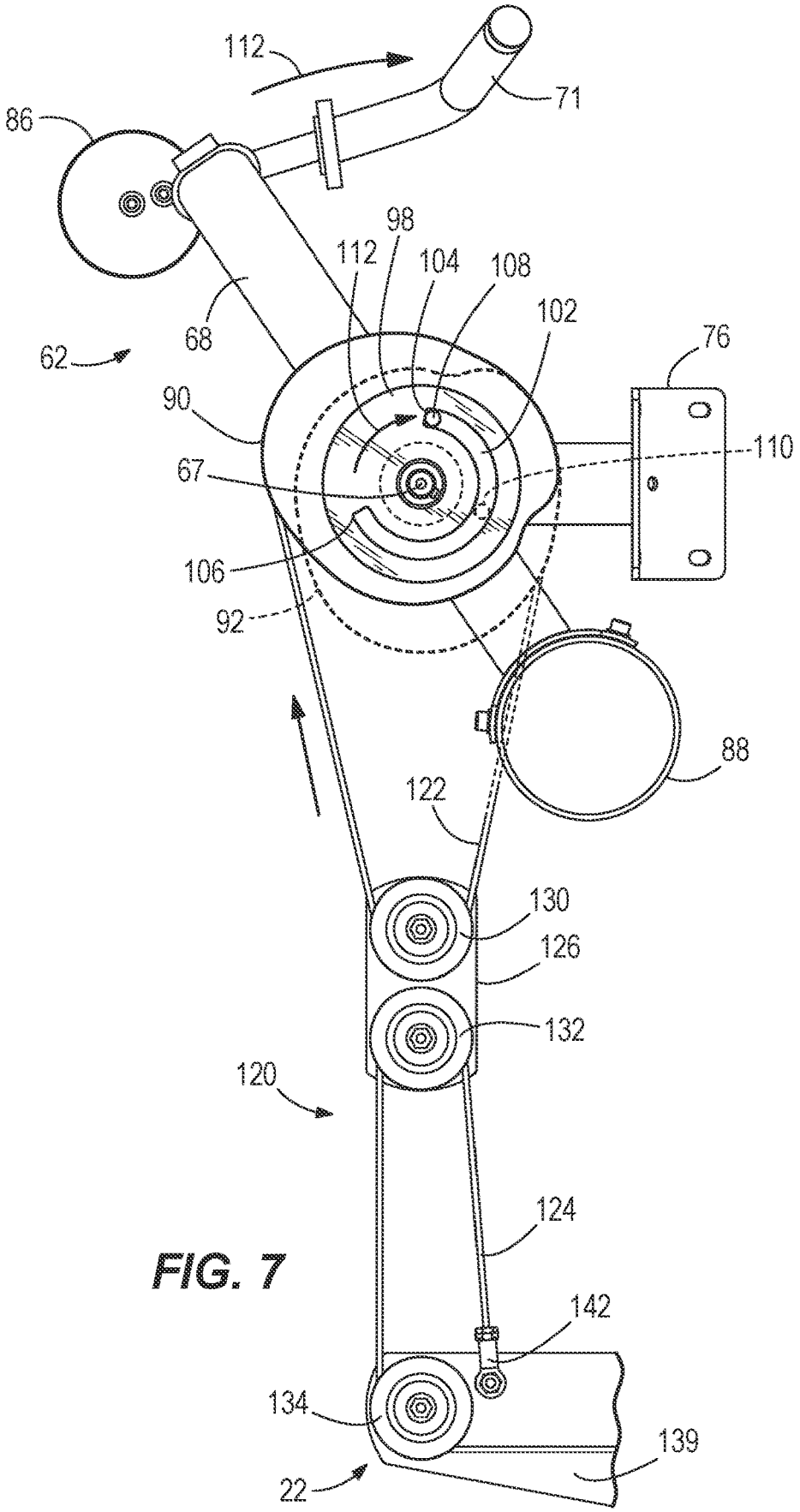
FIG. 7 is a view like FIG. 6, showing movement of the work arm during the biceps curl exercise motion.

Referring to FIGS. 6 and 7, the arcuate slot 102 and engagement fingers 108, 110 are configured such that rotation of the work arm 62 about the pivot axis 67 in a first direction 112 is for performing the biceps curl exercise motion. This rotates the driven shaft 69 and actuator plate 98 in the first direction 112, which causes the first slot end 104 to engage the engagement finger 108 and in turn rotate the first cam 90 about the pivot axis 67, while the engagement finger 110 of the second cam 92 rides along the arcuate slot 102 and the second cam 92 remains stationary.

Figure 8:
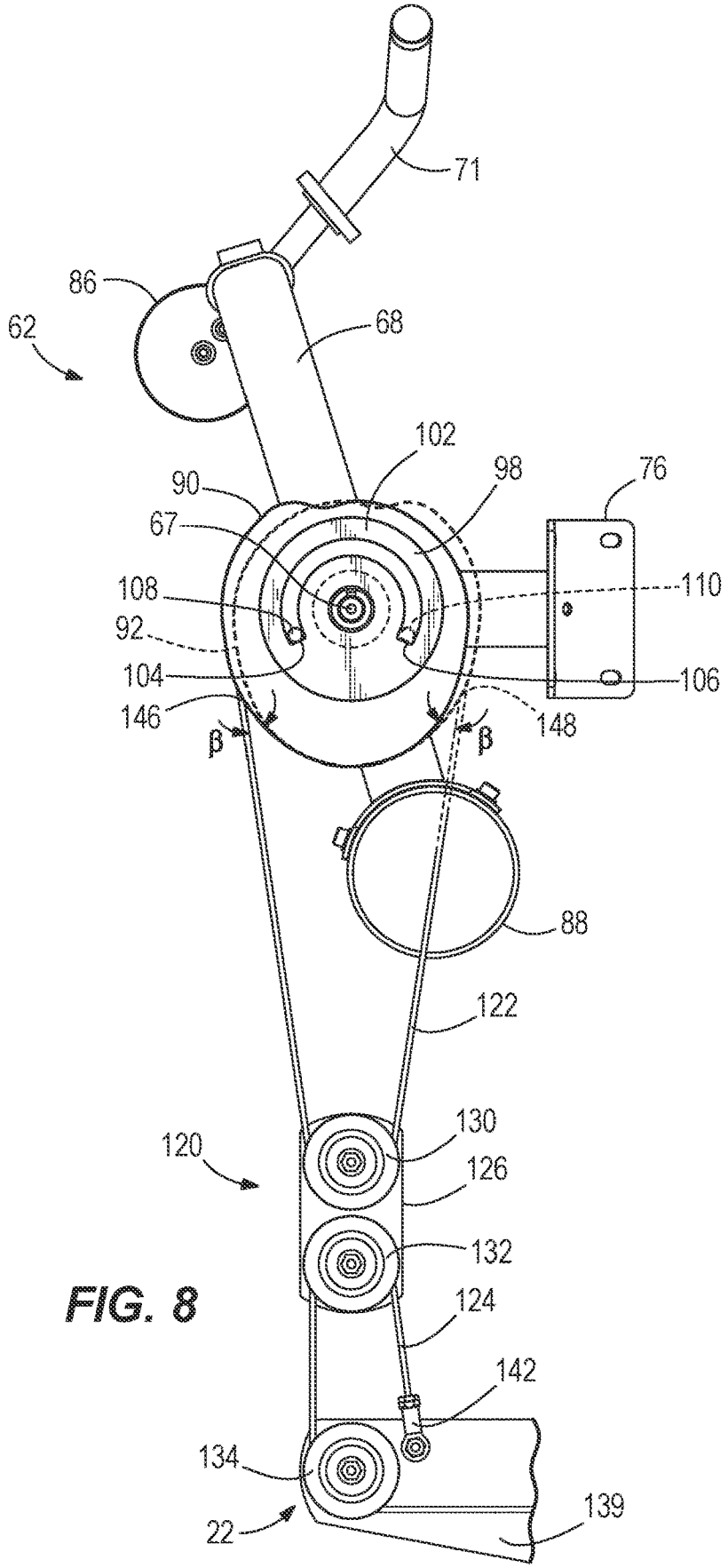
FIG. 8 is a view like FIG. 7, showing the work arm in a rest position for performance of a triceps extension exercise motion.
Figure 9:
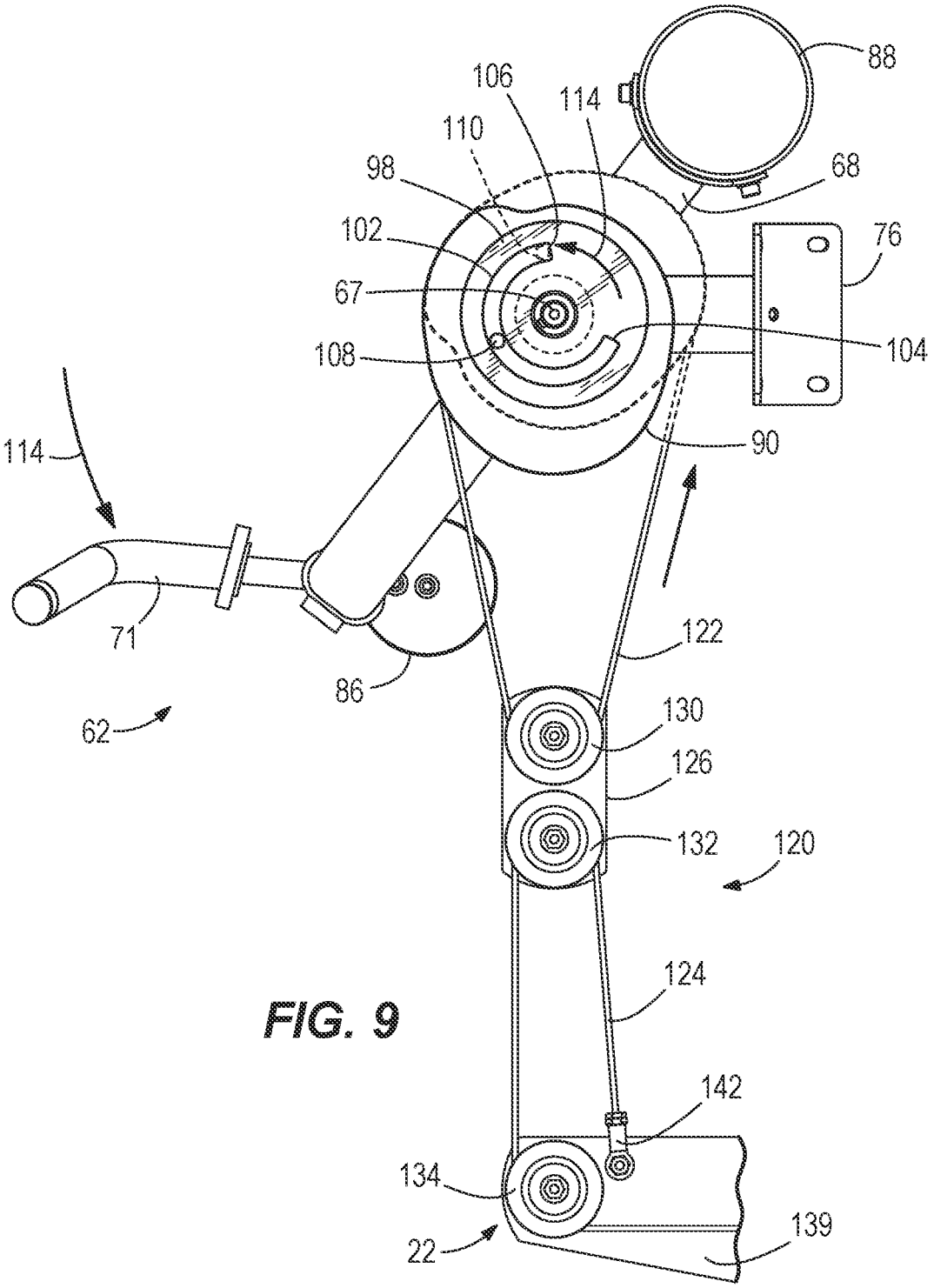
FIG. 9 is a view like FIG. 8, showing movement of the work arm during the triceps extension exercise motion.

Referring to FIGS. 8 and 9, the arcuate slot 102 and engagement fingers 108, 110 are further configured such that rotation of the work arm 62 about the pivot axis 67 in a second direction 114 is for performing the triceps extension exercise motion. This rotates the driven shaft 69 and actuator plate 98 in the second direction 114, which causes the second slot end 106 to engage the engagement finger 110 and in turn rotate the second cam 92 about the pivot axis 67, while the engagement finger 108 of the first cam 90 rides along the arcuate slot 102 and the first cam 90 remains stationary.

It will thus be understood that rotation of the driven shaft 69 rotates the actuator plate 98, which in turn selectively engages and rotates the first and second cams 90, 92, respectively. Movement of the work arm 62 in the first direction 112 rotates the driven shaft 69, which in turn rotates the first cam 90. Movement of the work arm 62 in the second direction 114 oppositely rotates the driven shaft 69, which in turn oppositely rotates the second cam 92. Moving the work arm 62 in the first direction 112 rotates the first cam 90 but not the second cam 92. Moving the work arm 62 in the second direction 114 rotates the second cam 92 but not the first cam 90.

Referring now to FIG. 3, the exercise machine 20 has a pulley assembly 120 that couples the work arm 62 to the weight stack 50 via the first and second cams 90, 92, in particular so that movement of the work arm in the first and second directions 112, 114 is resisted by the weight stack 50 according to resistance profiles determined by the outer perimeter shapes of the respective first and second cams 90, 92, respectively. The pulley assembly 120 includes a primary pulley cable 122, a secondary pulley cable 124, and a floating pulley device 126. The term "cable" used herein equally applies to and includes any flexible member for use in a pulley assembly, as conventional and known in the art, including but not limited to cables, belts, chains, wire ropes, and/or the like. The floating pulley device 126 has a primary pulley wheel 130 about which the primary pulley cable 122 extends and a secondary pulley wheel 132 about which the secondary pulley cable 124 extends. As shown in FIGS. 3 and 6, the pulley assembly 120 further includes a pair of lower pulley wheels 134, 136 mounted on a rigid bracket 139 extending from a lower portion of the support column 54, and a pair of upper pulley wheels 138, 140 mounted on the header 58 of the supporting frame 48 for the weight stack 50.

As shown in FIG. 3, the secondary pulley cable 124 has a first end 142 that is fixed to the stationary frame 22 via the rigid bracket 139 and a second end 144 coupled to the head plate 56 and bayonet 59 of the weight stack 50. The secondary pulley cable 124 is trained around the secondary pulley wheel 132 of the floating pulley device 126 and around the pair of lower pulley wheels 134, 136 and pair of upper pulley wheels 138, 140.

Referring to FIGS. 3 and 4, the primary pulley cable 122 extends through the floating pulley device 126 and is trained around the primary pulley wheel 130. The primary pulley cable 122 has a first end 146 affixed to the first cam 90 and a second end 148 affixed to the second cam 92.

Referring to FIG. 4, the first and second ends 146, 148 have ball ends 150, 152 that extend into radially extending bores 154, 156 in the first and second cams 90, 92. U-shaped clamps 160 retain the ball ends 150 152 in the bores 154, 156, thus coupling the first and second ends 146, 148 to the first and second cams 90, 92, respectively. The first and second cams 90, 92 each have an outer perimeter with a cable track 116, 118, which can have a profile shape that provides the same or different (which are herein referred to as "first and second" same or different) resistance profiles for the biceps curl exercise motion and triceps extension exercise motion, respectively. The first and second ends 146, 148 extend along the outer perimeters of the respective first and second cams 90, 92, along the cable tracks 116, 118.

Figure 10:
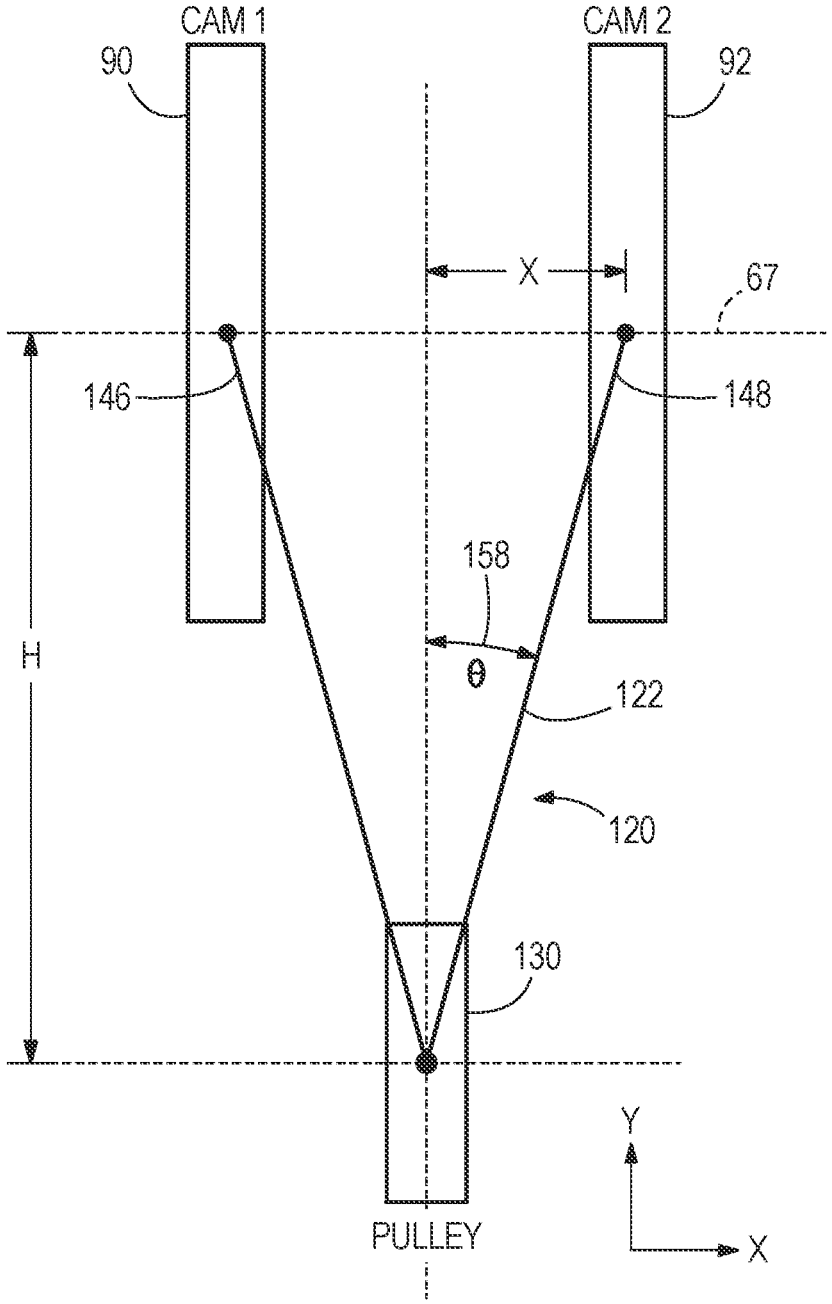
FIG. 10 is a schematic view showing the floating pulley device, first and second cams, and the fleet angle of the primary pulley cable relative to the first and second cams.

As shown schematically in FIG. 10, the first and second cams 90, 92 are rotatable about the common pivot axis 67 and the primary pulley wheel 130 is centered relative to the first and second cams 90, 92 such that the first and second ends 146, 148 of the primary pulley cable 122 extend at a fleet angle θ 158 relative to the first and second cams 90, 92. Preferably the fleet angle θ 158 remains less than or equal to three degrees to throughout the exercise motions to prevent wear over time on the primary pulley cable 122 and first and second cams 90, 92.

Referring to FIGS. 6 and 8, which show the rest position of the work arm 62 for the biceps curl exercise motion and triceps extension exercise motion, respectively, advantageously the first and second ends 146, 148 of the primary pulley cable 122 extend from the cable tracks 116, 118 of the first and second cams 90, 92 at a tangent R. This directed coupling and the separation of the first and second cams 90, 92 allows for continuous resistance in either exercise direction 112, 114 without the presence of a "dead zone" at take-off from either of the rest positions. The nature of a two-cam design and the orientation of the primary pulley cable 122 to the cable tracks 116, 118 allows for selection of resistance profiles that are completely independent of each other that can be tailored directly to the biomechanical requirements of each exercise. Referring to FIG. 10, the off-center position of the primary pulley wheel 130 allows for the quantity of pulley wheels to be minimized, since the primary pulley cable 122 is not required to be in-line with either of the first and second cam 90, 92. This advantageously allows for more simplified cable routing through the exercise machine 20.

FIG. 6 shows the first cam 90 in solid line format and the second cam 92 in dashed line format. The work arm 62 is shown in the rest position for performance of a biceps curl exercise motion. The first end 146 of the primary pulley cable 122 extends from the cable track 116 of the first cam 90 at a tangent β, such that when the user manually grasps the handles 71 and performs the biceps curl motion shown at arrow 112 in FIG. 7, the first end 146 of the primary pulley cable 122 is immediately wrapped on the cable track 116 of the first cam 90, due to its tangential orientation relative to the first cam 90. This causes the weight stack 50 to immediately resist the motion via the unique resistance profile provided by the first cam 90, i.e., without occurrence of a "dead zone", as such problem is described in the prior art U.S. Pat. No. 5,885,193.

FIG. 8 shows the work arm 62 in the rest position for performance of a triceps extension exercise motion. The second end 148 of the primary pulley cable 122 extends from the cable track 118 of the second cam 92 at a tangent β, such that when the user manually grasps the handles 71 and performs the triceps extension exercise motion shown at arrow 114 in FIG. 9, the second end 148 of the primary pulley cable 122 is immediately wrapped on the cable track 118 of the second cam 92, due to its tangential orientation relative to the second cam 92. This causes the weight stack to immediately resist the motion via the particular resistance profile provided by the second cam 92, i.e., without occurrence of a "dead zone", as such is described in the prior art U.S. Pat. No. 5,885,193.

It will thus be understood that the present disclosure thus provides embodiments of a bi-directional exercise machine comprising: a stationary frame; a resistance mechanism; a work arm coupled to the stationary frame, the work arm being movable in a first direction for performance of a first exercise motion and alternately being movable in an opposite, second direction for performance of a second exercise motion; a first cam having a cable track providing a first resistance profile for the first exercise motion and a second cam having a cable track providing a same or different, second resistance profile for the second exercise motion, wherein movement of the work arm in the first direction rotates the first cam and alternately wherein movement of the work arm in the second direction rotates the second cam; and a pulley assembly that couples the work arm to the resistance mechanism via the first and second cams, so that movement of the work arm is resisted by the resistance mechanism according to the first and second resistance profiles provided by the first and second cams. The pulley assembly comprises a primary pulley cable having a first end coupled to the first cam and a second end coupled to the second cam, and wherein when the work arm is in a rest position the first and second ends of the primary pulley cable both extend at a tangent from the cable tracks of the first and second cams, respectively, in particular so that the resistance mechanism applies a resistance force on the work arm via the pulley assembly immediately upon movement of the work arm out of the rest position.

In certain examples, the pulley assembly comprises a floating pulley device and a secondary pulley cable extending through the floating pulley device. The secondary pulley cable has a first end coupled to the stationary frame and a second end coupled to the resistance member. The floating pulley device comprises a primary pulley wheel around which the primary pulley cable extends and a secondary pulley wheel around which the secondary pulley cable extends. The first and second cams rotate about a common axis and wherein the primary pulley wheel is centered relative to the first and second cams such that the first and second ends of the primary pulley cable extend at fleet angle from the primary pulley wheel to the first and second cams, respectively.

In certain examples, moving the work arm in the first direction rotates the first cam but not the second cam and wherein moving the work arm in the second direction rotates the second cam but not the first cam. A driven shaft extends from the work arm, wherein movement of the work arm in the first direction rotates the driven shaft which in turn rotates the first cam, and wherein movement of the work arm in the second direction oppositely rotates the driven shaft which in turn oppositely rotates the second cam. An actuator plate disposed between the first and second cams, wherein rotation of the driven shaft rotates the actuator plate which in turn selectively engages and rotates the first and second cams, respectively. The actuator plate comprises an arcuate slot having a first slot end and an opposite second slot end, and wherein the first and second cams each has an engagement finger extending into the arcuate slot, wherein the arcuate slot and engagement fingers are configured such that moving the work arm in the first direction causes the first slot end to engage the engagement finger of the first cam and thus rotates the first cam, and such that moving the work arm in the second direction causes the second slot end to engage the engagement finger of the second cam and thus rotate the second cam.

The work arm is positionable into a bicep curl position in which moving of the work arm performs a bicep curl exercise motion and alternately into a triceps extension position in which moving of the work arm performs a triceps extension exercise motion. A selector mechanism is manually operable to position the work arm in the bicep curl position and alternately in the triceps extension position. The selector mechanism comprises an engagement plate on the stationary frame, the engagement plate having a first aperture for the bicep curl position and a second aperture for the triceps extension position, and further comprises a spring-loaded selector pin on the work arm for engaging with the first aperture and alternately the second aperture.

As used herein, "about," "approximately," "substantially," and "significantly" will be understood by persons of ordinary skill in the art and will vary to some extent on the context in which they are used. If there are uses of these terms which are not clear to persons of ordinary skill in the art given the context in which they are used, "about" and "approximately" will mean plus or minus <10% of the particular term and "substantially" and "significantly" will mean plus or minus >10% of the particular term.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A bi-directional exercise machine comprising:

a stationary frame;

a resistance mechanism;

a work arm coupled to the stationary frame, the work arm being movable in a first direction for performance of a first exercise motion and alternately being movable in an opposite, second direction for performance of a second exercise motion;

a first cam providing a first resistance profile for the first exercise motion and a second cam providing a same or different second resistance profile for the second exercise motion, wherein movement of the work arm in the first direction rotates the first cam and alternately wherein movement of the work arm in the second direction rotates the second cam; and a pulley assembly that couples the work arm to the resistance mechanism via the first and second cams, so that movement of the work arm is resisted by the resistance mechanism according to the first and second resistance profiles respectively provided by the first and second cams;

wherein the pulley assembly comprises a primary pulley cable having a first end coupled to the first cam and a second end coupled to the second cam, and wherein when the work arm is in a rest position, the first and second ends of the primary pulley cable both extend at a tangent from the first and second cams, respectively, so that the resistance mechanism applies a resistance force on the work arm via the pulley assembly immediately upon movement of the work arm out of the rest position; and wherein the pulley assembly further comprises a primary pulley wheel about which the primary pulley cable extends, wherein the first and second cams rotate about a common axis, and wherein the primary pulley wheel is centered relative to the first and second cams so that the first and second ends of the primary pulley cable extend at a fleet angle from the primary pulley wheel to the first and second cams, respectively.

2. The bi-directional exercise machine according to claim 1, wherein the pulley assembly further comprises a floating pulley device, and wherein the primary pulley cable extends through the floating pulley device.

3. The bi-directional exercise machine according to claim 2, wherein the pulley assembly further comprises a secondary pulley cable extending through the floating pulley device, the secondary pulley cable having a first end coupled to the stationary frame and a second end coupled to the resistance mechanism.

4. The bi-directional exercise machine according to claim 3, wherein the floating pulley device comprises the primary pulley wheel around which the primary pulley cable extends and a secondary pulley wheel around which the secondary pulley cable extends.

5. The bi-directional exercise machine according to claim 1, wherein the fleet angle is less than or equal to three degrees throughout the first and second exercise motions.

6. The bi-directional exercise machine according to claim 1, wherein moving the work arm in the first direction rotates the first cam but not the second cam and wherein moving the work arm in the second direction rotates the second cam but not the first cam.

7. The bi-directional exercise machine according to claim 1, further comprising a driven shaft extending from the work arm, wherein movement of the work arm in the first direction rotates the driven shaft which in turn rotates the first cam, and wherein movement of the work arm in the second direction oppositely rotates the driven shaft which in turn oppositely rotates the second cam.

8. A bi-directional exercise machine comprising:

a stationary frame;

a resistance mechanism;

a work arm coupled to the stationary frame, the work arm being movable in a first direction for performance of a first exercise motion and alternately being movable in an opposite, second direction for performance of a second exercise motion;

a first cam having a cable track providing a first resistance profile for the first exercise motion and a second cam having a cable track providing a same or different second resistance profile for the second exercise motion, wherein movement of the work arm in the first direction rotates the first cam and alternately wherein movement of the work arm in the second direction rotates the second cam; and a pulley assembly that couples the work arm to the resistance mechanism via the first and second cams, so that movement of the work arm is resisted by the resistance mechanism according to the first and second resistance profiles respectively provided by the first and second cams;

wherein the pulley assembly comprises a primary pulley cable having a first end coupled to the first cam and a second end coupled to the second cam, and wherein when the work arm is in a rest position, the first and second ends of the primary pulley cable both extend at a tangent from the cable tracks of the first and second cams, respectively, so that the resistance mechanism applies a resistance force on the work arm via the pulley assembly immediately upon movement of the work arm out of the rest position, wherein the pulley assembly further comprises a floating pulley device, and wherein the primary pulley cable extends through the floating pulley device, wherein the pulley assembly further comprises a secondary pulley cable extending through the floating pulley device, the secondary pulley cable having a first end coupled to the stationary frame and a second end coupled to the resistance mechanism, wherein the floating pulley device comprises a primary pulley wheel around which the primary pulley cable extends and a secondary pulley wheel around which the secondary pulley cable extends, and wherein the first and second cams rotate about a common axis and wherein the primary pulley wheel is centered relative to the first and second cams so that the first and second ends of the primary pulley cable respectively extend at the tangent from the cable tracks of the first and second cams and at a fleet angle from the primary pulley wheel to the first and second cams, respectively.

9. A bi-directional exercise machine comprising:

a stationary frame;

a resistance mechanism;

a work arm coupled to the stationary frame, the work arm being movable in a first direction for performance of a first exercise motion and alternately being movable in an opposite, second direction for performance of a second exercise motion;

a first cam having a cable track providing a first resistance profile for the first exercise motion and a second cam having a cable track providing a same or different second resistance profile for the second exercise motion, wherein movement of the work arm in the first direction rotates the first cam and alternately wherein movement of the work arm in the second direction rotates the second cam; and a pulley assembly that couples the work arm to the resistance mechanism via the first and second cams, so that movement of the work arm is resisted by the resistance mechanism according to the first and second resistance profiles respectively provided by the first and second cams;

wherein the pulley assembly comprises a primary pulley cable having a first end coupled to the first cam and a second end coupled to the second cam, and wherein when the work arm is in a rest position, the first and second ends of the primary pulley cable both extend at a tangent from the cable tracks of the first and second cams, respectively, so that the resistance mechanism applies a resistance force on the work arm via the pulley assembly immediately upon movement of the work arm out of the rest position, further comprising a driven shaft extending from the work arm, wherein movement of the work arm in the first direction rotates the driven shaft which in turn rotates the first cam, and wherein movement of the work arm in the second direction oppositely rotates the driven shaft which in turn oppositely rotates the second cam, and further comprising an actuator plate disposed between the first and second cams, wherein rotation of the driven shaft rotates the actuator plate which in turn selectively engages and rotates the first and second cams, respectively.

10. The bi-directional exercise machine according to claim 9, wherein the actuator plate comprises an arcuate slot having a first slot end and an opposite second slot end, and wherein the first and second cams each has an engagement finger extending into the arcuate slot, wherein the arcuate slot and engagement fingers are configured so that moving the work arm in the first direction causes the first slot end to engage the engagement finger of the first cam and thus rotates the first cam, and so that moving the work arm in the second direction causes the second slot end to engage the engagement finger of the second cam and thus rotates the second cam.

11. A bi-directional exercise machine comprising:

a stationary frame;

a work arm pivotably coupled to the stationary frame;

first and second cams coupled to the work arm so that pivoting of the work arm in a first direction rotates the first cam but not the second cam and so that pivoting of the work arm in a second direction rotates the second cam but not the first cam;

a resistance mechanism; and a pulley assembly that couples the resistance mechanism to the work arm via the first and second cams so that movement of the work arm is resisted by the resistance mechanism according to first and second resistance profiles respectively provided by the first and second cams, wherein the pulley assembly comprises a primary pulley cable having a first end coupled to the first cam and a second end coupled to the second cam, so that the resistance mechanism applies a resistance force on the work arm via the pulley assembly immediately upon movement of the work arm out of a rest position;

wherein the pulley assembly further comprises a floating pulley device, and wherein the primary pulley cable extends through the floating pulley device, and wherein the first and second cams rotate about a common axis and wherein the floating pulley device is centered relative to the first and second cams so that the first and second ends of the primary pulley cable extend at a tangent from the first and second cams and at a fleet angle from the floating pulley device to the first and second cams, respectively.

12. The bi-directional exercise machine according to claim 11, wherein the work arm is positionable into a biceps curl position in which moving of the work arm performs a biceps curl exercise motion and alternately into a triceps extension position in which moving of the work arm performs a triceps extension exercise motion.

13. The bi-directional exercise machine according to claim 12, further comprising a selector mechanism that is manually operable to position the work arm in the biceps curl position and alternately in the triceps extension position.

14. The bi-directional exercise machine according to claim 13, wherein the selector mechanism comprises an engagement plate on the stationary frame, the engagement plate having a first aperture for the biceps curl position and a second aperture for the triceps extension position, and further comprises a spring-loaded selector pin on the work arm for engaging with the first aperture and alternately the second aperture.

15. The bi-directional exercise machine according to claim 11, wherein the pulley assembly further comprises a secondary pulley cable extending through the floating pulley device, the secondary pulley cable having a first end coupled to the resistance mechanism and a second end coupled to the stationary frame.

16. The bi-directional exercise machine according to claim 15, wherein the floating pulley device further comprises a primary pulley wheel around which the primary pulley cable extends and a secondary pulley wheel around which the secondary pulley cable extends.

17. A bi-directional exercise machine comprising:

a stationary frame;

a work arm pivotably coupled to the stationary frame;

first and second cams coupled to the work arm so that pivoting of the work arm in a first direction rotates the first cam but not the second cam and so that pivoting of the work arm in a second direction rotates the second cam but not the first cam;

a resistance mechanism; and a pulley assembly that couples the resistance mechanism to the work arm via the first and second cams so that movement of the work arm is resisted by the resistance mechanism according to first and second resistance profiles respectively provided by the first and second cams, wherein the pulley assembly comprises a primary pulley cable having a first end coupled to the first cam and a second end coupled to the second cam, so that the resistance mechanism applies a resistance force on the work arm via the pulley assembly immediately upon movement of the work arm out of a rest position, wherein the pulley assembly further comprises a floating pulley device, wherein the primary pulley cable extends through the floating pulley device, wherein the pulley assembly further comprises a secondary pulley cable extending through the floating pulley device, the secondary pulley cable having a first end coupled to the resistance mechanism and a second end coupled to the stationary frame, wherein the floating pulley device comprises a primary pulley wheel around which the primary pulley cable extends and a secondary pulley wheel around which the secondary pulley cable extends, and wherein the first and second cams rotate about a common axis and wherein the primary pulley wheel is centered relative to the first and second cams so that the first and second ends of the primary pulley cable extend at a fleet angle from the primary pulley wheel to the first and second cams, respectively.

18. The bi-directional exercise machine according to claim 17, wherein the fleet angle is less than or equal to three degrees throughout a first exercise motion and a second exercise motion opposite the first exercise motion, wherein performance of the first exercise motion pivots the work arm in the first direction, and wherein performance of the second exercise motion pivots the work arm in the second direction.

19. A bi-directional exercise machine comprising:

a work arm;

first and second cams coupled to the work arm so that pivoting of the work arm in a first direction rotates the first cam but not the second cam and so that pivoting of the work arm in a second direction rotates the second cam but not the first cam;

a resistance mechanism; and a pulley assembly that couples the resistance mechanism to the work arm via the first and second cams so that movement of the work arm is resisted by the resistance mechanism according to first and second resistance profiles provided by the first and second cams, respectively, wherein the pulley assembly comprises a primary pulley cable having a first end coupled to the first cam and a second end coupled to the second cam, and wherein when the work arm is in a rest position the first and second ends of the primary pulley cable both extend at a tangent from cable tracks of the first and second cams, respectively, so that the resistance mechanism applies a resistance force on the work arm via the pulley assembly immediately upon movement of the work arm out of the rest position;

wherein the pulley assembly further comprises a primary pulley wheel about which the primary pulley cable extends, wherein the first and second cams rotate about a common axis, and wherein the primary pulley wheel is centered relative to the first and second cams so that the first and second ends of the primary pulley cable extend at a fleet angle from the primary pulley wheel to the first and second cams, respectively.

20. A bi-directional exercise machine comprising:

a stationary frame;

a resistance mechanism;

a work arm coupled to the stationary frame, the work arm being movable in a first direction for performance of a first exercise motion and alternately being movable in an opposite, second direction for performance of a second exercise motion;

a first cam providing a first resistance profile for the first exercise motion and a second cam providing a same or different second resistance profile for the second exercise motion, wherein movement of the work arm in the first direction rotates the first cam and alternately wherein movement of the work arm in the second direction rotates the second cam; and a pulley assembly that couples the work arm to the resistance mechanism via the first and second cams, so that movement of the work arm is resisted by the resistance mechanism according to the first and second resistance profiles respectively provided by the first and second cams;

wherein the pulley assembly comprises a primary pulley cable having a first end coupled to the first cam and a second end coupled to the second cam, and wherein when the work arm is in a rest position, the first and second ends of the primary pulley cable both extend at a tangent from the cable tracks of the first and second cams, respectively, so that the resistance mechanism applies a resistance force on the work arm via the pulley assembly immediately upon movement of the work arm out of the rest position, and further comprising a driven shaft extending from the work arm, wherein movement of the work arm in the first direction rotates the driven shaft which in turn rotates the first cam, and wherein movement of the work arm in the second direction oppositely rotates the driven shaft which in turn oppositely rotates the second cam, and further comprising an actuator plate disposed between the first and second cams, wherein rotation of the driven shaft rotates the actuator plate which in turn selectively engages and rotates the first and second cams, respectively.

* * * * *